US005183166A

United States Patent [19]

Belokin, Jr. et al.

[11] Patent Number: 5,183,166

[45] Date of Patent: Feb. 2, 1993

[54] FOLDABLE SHELF DISPLAY

[76] Inventors: Paul Belokin, Jr.; Martin P. Belokin; Norman P. Belokin, all of 7801 I-35N and Milam Rd., Denton, Tex. 76201

[21] Appl. No.: 638,082

[22] Filed: Jan. 7, 1991

[51] Int. Cl.[5] ..... A47F 5/08

[52] U.S. Cl. ..... 211/149; 211/130; 211/188; 211/73; 248/174

[58] Field of Search ..... 211/85, 149, 77, 72, 211/73, 130, 132, 188; 248/174; 206/44 K, 45.19; 229/115

[56] References Cited

U.S. PATENT DOCUMENTS

| | | | |
|---|---|---|---|
| 1,090,142 | 3/1914 | Fischer | 248/174 |
| 1,598,235 | 8/1926 | Barbieri | 229/115 X |
| 2,102,982 | 12/1937 | Taylor | 211/77 X |
| 2,173,494 | 9/1939 | Rous | 229/115 X |
| 2,727,620 | 12/1955 | Buttery | 206/45.19 |
| 3,420,362 | 1/1969 | Kleingers, Jr. | 248/174 |
| 3,428,235 | 2/1969 | Randazzo | 229/115 X |
| 3,931,894 | 1/1976 | Murphy | 211/189 |
| 4,311,100 | 1/1982 | Gardner et al. | 211/149 X |
| 4,339,067 | 7/1982 | Bessey | 229/115 |
| 4,895,260 | 1/1990 | Ancona et al. | 211/77 |

*Primary Examiner*—Alvin C. Chin-Shue
*Assistant Examiner*—Korie H. Chan
*Attorney, Agent, or Firm*—Wood, Phillips, VanSanten, Hoffman & Ertel

[57] ABSTRACT

A foldable display stand includes a wall blank having substantially flat wall panels connected end to end foldably relative to each other to define a continuous wall structure. The wall blank is convertible to a flattened state for storage and transportation and an expanded display state in which a number of wall panels cooperatively bound a polygonal display space. Each of two side wall panels has a flap foldable inwardly to place the flaps in juxtaposition so as to form a polygonal shelf within the display space. The shelf and rear wall panel are interconnected by shelf tabs fitting releasably within a slot in the rear wall panel. A removable tray is supported on the polygonal shelf and braces the interior of the continuous wall structure. The tray is releasably secured within the display space. The display stands are modular and may be releasably vertically stacked. Openings in the continuous wall structure are formed of a geometrical configuration to receive articles having a similar configuration.

15 Claims, 5 Drawing Sheets

FOLDABLE SHELF DISPLAY

BACKGROUND OF THE INVENTION

1. Technical Field

This invention relates to prefabricated display stands for exhibiting merchandise and, more particularly, to a collapsible display stand having opposed display faces with inwardly foldable flaps to establish a shelf for supporting removable trays.

2. Prior Art

Prefabricated stands are commonly used for displaying merchandise in retail establishments, particularly supermarkets. It is known to make stands from cardboard or similar material that is compatible with low cost and lightweight construction.

An exemplary structure is shown in my earlier U.S. Pat. No. 4,630,740, which discloses a rectangular modular display stand having two pairs of opposed, facing panels which bound an interior storage space. Each panel has an associated flap with teeth for intermeshing with the remaining teeth when the flaps are placed in a mutually overlapping relationship to define a shelf for placement of display articles. While this design has proved successful for many years, it requires the relatively cumbersome task of interconnecting four flaps to define a single support platform.

More importantly, my earlier invention requires that the articles which are be displayed are arranged directly on the display stand. As a shelf is emptied by purchasers of the articles, there is no provision for simply restocking a pre-arranged display of articles onto a shelf. Depending on the nature of the goods being displayed, it can be desirable to have the capability of rapidly restocking an emptied shelf in certain applications.

The present invention is specifically directed to overcoming the above enumerated limitations in a novel and simple manner.

SUMMARY OF THE INVENTION

An object, therefore, of the invention is to provide an improved display stand that can be readily converted from a flattened storage and shipment state to a display state without the use of tools to establish a novel display arrangement.

In the exemplary embodiment of the invention, a foldable display stand includes a wall blank having substantially flat wall panels connected end to end foldably relative to each other to define a continuous wall structure. The wall blank is convertible to a flattened state for storage and transportation and to an expanded display state in which a number of wall panels cooperatively bound a polygonal display space. Two of the panels are converging side wall panels which are joined forwardly at a common fold line, and another of the wall panels is a rear wall panel which interconnects the two side wall panels. Flaps with associated tabs are foldably associated with each of the side wall panels. The tabs of each flap are received removably in a slot formed in the rear panel so that the flaps are positioned and held in a juxtaposed relationship to define a shelf within the polygonal display space. A removable tray is supported on the shelf for articles to be displayed. The tray also braces the continuous wall structure of the device.

In one form of the invention, a forward pillar extends upwardly between the converging side wall panels and has a notch which receives a forward edge portion of the removable tray to stabilize the position of the tray on the display stand. The tray makes a firm frictional engagement with the rear wall panel and with the pillar when positioned in the notch. The forward edge portion has an upwardly folded lip to enhance securement of the tray in the notch. Apertures extend through the wall panels and are shaped to support additional display articles.

The invention also contemplates an embodiment in which the two display panels are joined to the pillar at different fold lines, such that a front panel is formed on the pillar which is substantially parallel to the rear panel. Apertures also are formed in the front panel and are shaped to support additional articles for display.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE INVENTION

Figure 1:
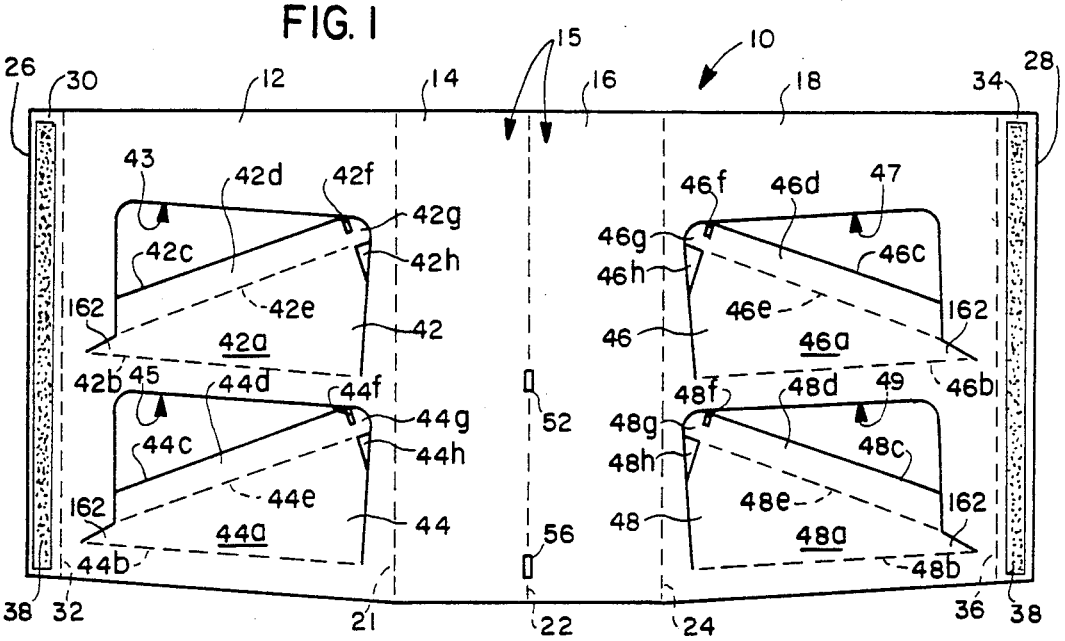
FIG. 1 is an elevational view of a blank used to form an upper display module according to the present invention.
Figure 2:
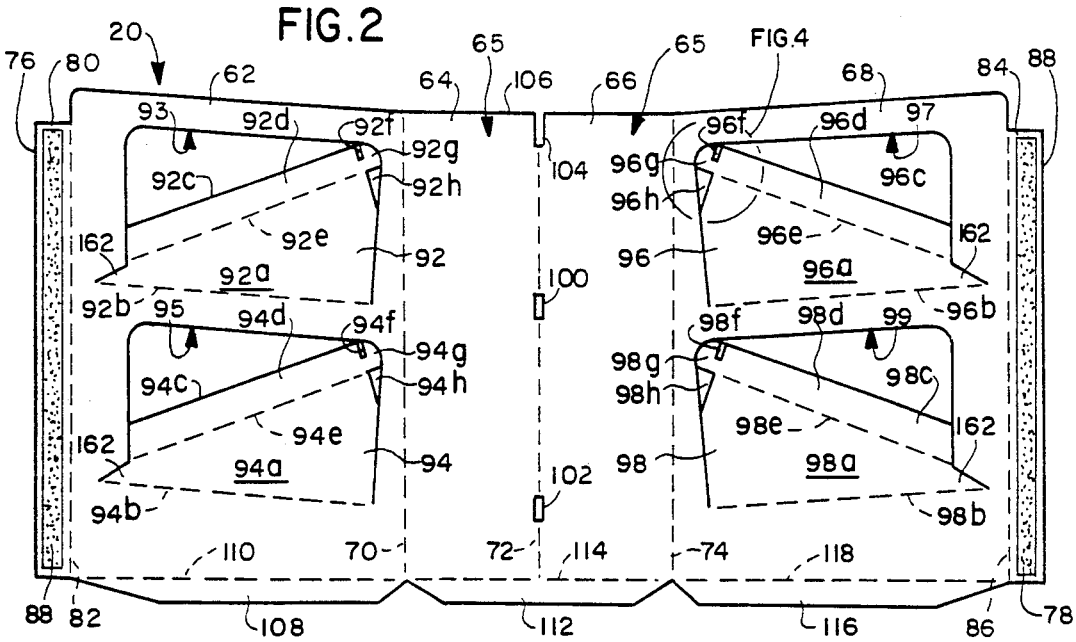
FIG. 2 is an elevational view of a blank used to form a lower display module according to the present invention.

A blank used to construct display modules for a foldable shelf display according to the present invention are depicted in FIGS. 1 and 2 generally at 10 and 20, respectively. Preferably, the blanks are made from cardboard stock having sufficient rigidity to maintain their shape yet remain light in weight.

Figure 5:
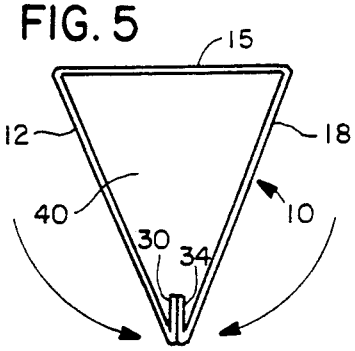
FIG. 5 is a top view of the blank illustrated in FIG. 1 in a folded state to form the continuous wall structure.

Blank 10 comprises a series of wall panels 12, 14, 16 and 18 connected end to end foldably relative to each other about lines 21, 22, and 24 that may be perforated, scored, or otherwise weakened so that folding of the panels relative to each other occurs in a predetermined fashion. Wall panels 14 and 16 when foldably aligned cooperatively provide a single rear wall panel 15, as illustrated in FIG. 5. To provide a continuous wall structure, the free ends 26 and 28 of the blank are joined. The end 26 has an integral flap 30 which is bendable about a fold line 32 relative to panel 12. The end 28 has an integral flap 34 which is bendable about a fold line 36 relative to panel 18. An adhesive 38 of a type known to those skilled in the art is used to facially mate the inwardly folded flap 30 on panel 12 with the inwardly folded flap 34 on panel 18 such that the wall panels cooperatively form the continuous wall structure and bound a triangulated interior storage space 40 (see FIG. 5).

A pair of flaps 42 and 44 are struck from and remain integral with side wall panel 12, and a pair of flaps 46 and 48 are struck from and remain integral with wall panel 18. Flap 42 comprises a shelf panel **42*a* bendable about a fold line 42*b*. A free edge 42*c* has an integral marginal edge portion 42*d* which is bendable about a fold line 42*e* and has a notch 42*f* formed therein to define a tab 42*g* on the flap 42. Fold line 42*b* is preferably downwardly inclined with respect to fold line 21, and shelf panel 42*a* is angularly cut at 42*h* for purposes later to be discussed. Bending of flap 42 about fold line 42*b* establishes a generally rectangular opening 43 in panel 12**.

Similarly, flap 44 comprises a shelf panel **44*a* bendable about a fold line 44*b*. A free edge 44*c* has an integral marginal edge portion 44*d* which is bendable about a fold line 44*e* and has a notch 44*f* formed therein to define a tab 44*g* on the flap 44. Again, fold line 44*b* is preferably downwardly inclined with respect to fold line 21, and shelf panel 42*a* is angularly cut at 44*h*. Bending of flap 44 about fold line 44*b* establishes a generally rectangular opening 45 in panel 12**.

Flap 46 on side wall panel 18 comprises a shelf panel **46*a* bendable about a fold line 46*b*. A free edge 46*c* has an integral panel 46*d* which is bendable about a fold line 46*e* and has a notch 46*f* formed therein to define a tab 46*g* on the flap 46. Fold line 46*b* is downwardly inclined with respect to fold line 24, and shelf panel 46*a* is angularly cut at 46*h*. Bending of flap 46 about fold line 46*b* establishes a generally rectangular opening 47 in side wall panel 18. Similarly, flap 48 comprises a shelf panel 48*a* bendable about a fold line 48*b*. A free edge 48*c* has an integral panel 48*d* which is bendable about a fold line 48*e* and has a notch 48*f* formed therein to define a tab 48*g* on the flap 48. Again, fold line 48*b* is downwardly inclined with respect to fold line 24, and shelf panel 48*a* is angularly cut at 48*h*. Bending of flap 48 about fold line 48*b* establishes a generally rectangular opening 49 in side wall panel 18**.

Figure 6:
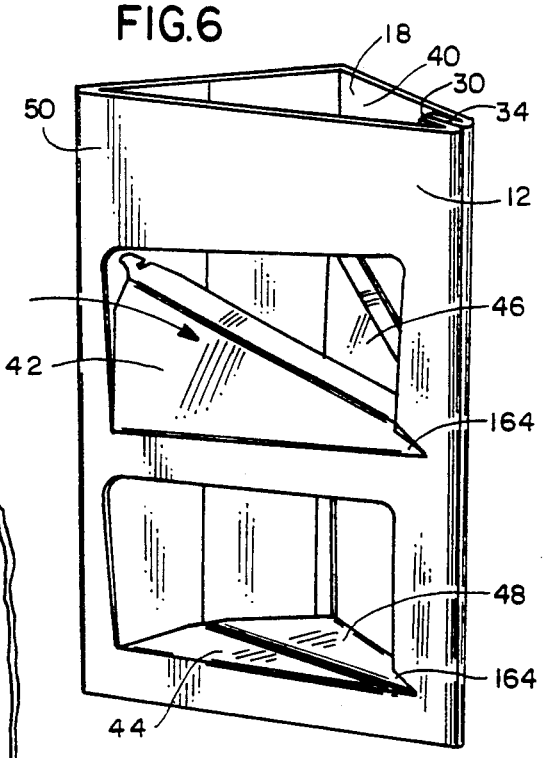
FIG. 6 is a perspective view of the top display module demonstrating the step of folding first and second flaps of a side wall panel downwardly to define a shelf.
Figure 7:
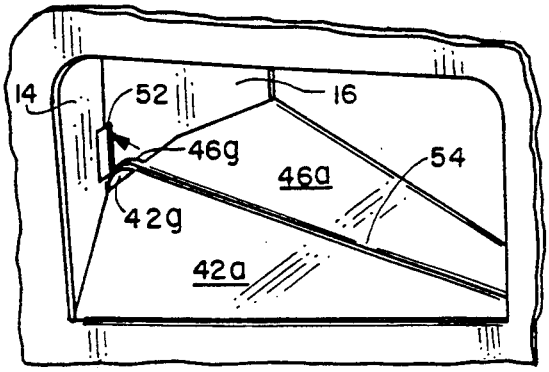
FIG. 7 is a broken-out perspective view of a display module demonstrating the step of interconnecting first and second flaps with a rear panel of the display module.
Figure 8:
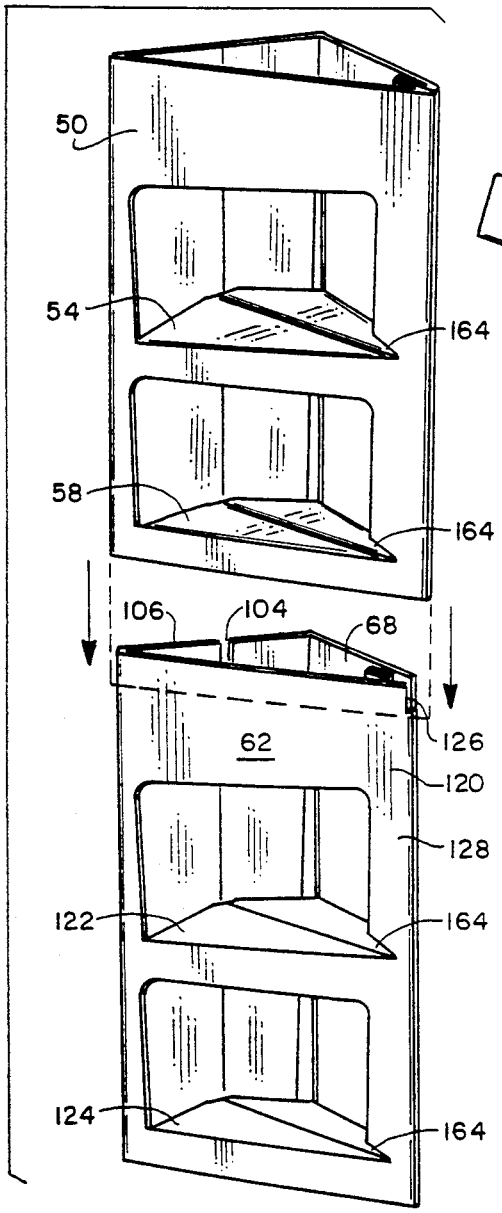
FIG. 8 is an exploded perspective view of an upper display module and a lower display module and demonstrating the step of assembling the modules to form a display device.

The steps for converting a display module from the flattened state illustrated in FIG. 1 to a display state illustrated in FIG. 8 are demonstrated in FIGS. 6 and 7. As described above, initially the flap 30 on panel 12 is inwardly folded and facially mated with the inwardly folded flap 34 on panel 18 by means of a suitable adhesive 38 to form an upper display module 50 defining triangulated interior display or storage space 40. Integral panels **42*d* and 46*d* are then folded substantially 90 degrees about fold lines 42*e* and 46*e*, respectively, and the flaps 42 and 46 are inwardly folded substantially 90 degrees about fold lines 42*b* and 46*b*, respectively, to facially mate panels 42*d* and 46*d*. Because of the downward inclination of fold lines 42*b* and 46*b* pointed out above, panels 42*a* and 46*a* each swing arcuately and slightly rearwardly to position the angular cuts at 42*h* and 46*h* adjacent rear wall panel 15**.

Notches **42*f* and 46*f* of tabs 42*g*, 46*g* are then engaged in an opening or slot 52 formed in rear wall panel 15 such that tabs 42*g* and 46*g* project through the rear panel to secure and support flaps 42 and 46 in juxtaposed relationship with one another to define a first shelf 54 slightly rearwardly inclined within the triangulated storage space 40 for placement of articles to be displayed. When the tabs are thus engaged, the angular cuts at 42*h*, 46*h* are colinear and braced against the rear wall panel 15 in close frictional engagement therewith, as shown in FIG. 8**.

As shown in FIG. 1, the lower flap 44 is substantially identical to flap 42 in structure and orientation; and the lower flap 48 is substantially identical to flap 46 in structure and orientation. Thus in a manner similar to that described in relation to flaps 42 and 46, integral panels **44*d* and 48*d* are folded substantially 90 degrees about fold lines 44*e* and 48*e*, respectively, and the flaps 44 and 48 are inwardly folded substantially 90 degrees about fold lines 44*b* and 48*b*, respectively, to facially mate panels 44*d* and 48*d*. Notches 44*f* and 48*f* engage an opening or slot 56 formed in rear wall panel 15 such that tabs 44*g* and 48*g* project through the rear panel to secure and support flaps 44 and 48 in juxtaposed relationship with one another to define a second shelf 58 beneath first shelf 54. Again, the panels 44*a* and 48*a* each swing arcuately and slightly rearwardly to position the angular cuts 44*h* and 48*h* against the rear wall panel 15** in a close bracing relationship to rigidify the continuous wall structure.

Referring to FIG. 2, blank 20 is generally similar to blank 10 and has a series of wall panels 62, 64, 66 and 68 connected end to end foldably relative to each other about lines 70, 72, and 74 that may be perforated, scored, or otherwise weakened so that folding of the panels relative to each other occurs in a predetermined fashion. Wall panels 64 and 66 cooperatively provide a single rear wall panel 65. To provide a continuous wall structure, the free ends 76 and 78 of the blank are joined. The end 76 has an integral flap 80 which is bendable about a fold line 82 relative to panel 62. The end 78 has an integral flap 84 which is bendable about a fold line 86 relative to panel 68. A common adhesive 88 is used to secure the facially mating of inwardly folded flap 80 on panel 62 with the inwardly folded flap 84 on panel 68 to form a triangulated interior display or storage space.

A pair of similar flaps 92 and 94 are struck from and remain integral with wall panel 62, and a pair of similar flaps 96 and 98 are struck from a remain integral with wall panel 68. These flaps 92, 94, 96,98 are similar respectively to flaps 42, 44, 46, 48 in structure, orientation and function. Flap 92 comprises a shelf panel 92*a* bendable about a fold line 92*b*. A free edge 92*c* has an integral panel 92*d* which is bendable about a fold line 92*e* and has a notch 92*f* formed therein to define a tab 92*g* on the flap 92. Bending of flap 92 about fold line 92*b* establishes a generally rectangular opening 93 in panel 62. Similarly, flap 94 comprises a shelf panel 94*a* bendable about a fold line 94*b*. A free edge 94*c* has an integral panel 94*d* which is bendable about a fold line 94*e* and has a notch 94*f* formed therein to define a tab 94*g* on the flap 94. Bending of flap 94 about fold line 94*b* establishes a generally rectangular opening 95 in panel 62.

Flap 96 comprises a shelf panel 96*a* bendable about a fold line 96*b*. A free edge 96*c* has an integral panel 96*d* which is bendable about a fold line 96*e* and has a notch 96*f* formed therein to define a tab 96*g* on the flap 96 Bending of flap 96 about fold line 96*b* establishes a generally rectangular opening 97 in panel 68. Similarly, flap 98 comprises a shelf panel 98*a* bendable about a fold line 98*b*. A free edge 98*c* has an integral panel 98*d* which is bendable about a fold line 98*e* and has a notch 98*f* formed therein to define a tab 98*g* on the flap 98. Bending of flap 98 about fold line 98*b* establishes a generally rectangular opening 99 in panel 68. Each of the flaps 92, 94, 96, 98 have angular cuts at 92*h*, 94*h*, 96*h* and 98*h* for purposes previously described.

Formed along fold line 72 between wall panels 64 and 66 are a pair of spaced apart slots or openings 100 and 102. An upwardly opening slot 104 is formed in alignment with the openings 100 and 102 and communicates with an edge 106 of the blank 20. A foldable lip 108 is joined to panel 62 about a fold line 110; a foldable lip 112 is joined to rear wall panel 65 about a fold line 114; and a foldable lip 116 is joined to wall panel 68 about a fold line 118.

As may be appreciated from the foregoing, the steps for converting a display module from the flattened state illustrated in FIG. 2 to a display state illustrated in FIG. 8 are substantially identical to those described above with respect to upper display module 50. Initially the flap 80 on panel 62 is inwardly folded and facially mated with the inwardly folded flap 84 on panel 68 by means of a suitable adhesive 88 to form a lower display module 120. As will be shown, display module 120 is a lower display module. Lip portions 108, 112, and 116 are upwardly folded about fold lines 110, 114, and 118, respectively, to define a stable platform upon which the module is supported.

Integral panels 92*d* and 96*d* are then folded substantially 90 degrees about fold lines 92*e* and 96*e*, respectively, and the flaps 92 and 96 are inwardly folded substantially 90 degrees about fold lines 92*b* and 96*b*, respectively, to facially mate panels 92*d* and 96*d*. Notches 92*f* and 96*f* engage opening 100 such that tabs 92*g* and 96*g* project through the rear panel to secure and support flaps 92 and 96 in juxtaposed relationship with one another to define a first shelf 122 within the display module. Similarly, integral panels 94*d* and 98*d* are folded substantially 90 degrees about fold lines 94*e* and 98*e*, respectively, and the flaps 94 and 98 are inwardly folded substantially 90 degrees about fold lines 94*b* and 98*b*, respectively, to facially mate panels 94*d* and 98*d*. Notches 94*f* and 98*f* engage opening 102 such that tabs 94*g* and 98*g* project through the rear panel to secure and support flaps 94 and 98 in juxtaposed relationship with one another to define a second shelf 124 beneath first shelf 122.

As illustrated in FIG. 8, upper display module 50 and lower display module 120 are arranged in stacked relation to define a four-shelf display tower. Tabs 42*g* and 46*g* projecting through the rear panel of display module 50 are aligned with slot 104 formed in upper edge 106 of display module 120, and inwardly folded flaps 30 and 34 (FIG. 5) are aligned with a notch 126 (FIG. 8) formed in a support pillar 128 extending vertically between wall panels 62 and 68. Upper display module is moved downwardly into telescoping engagement with the lower display module, such that tabs 42*g* and 46*g* are received in slot 104 in rear wall panel 15 and flaps 30 and 34 are received forwardly in the notch 126 to rigidify the stacked arrangement fore and aft.

Figure 3:
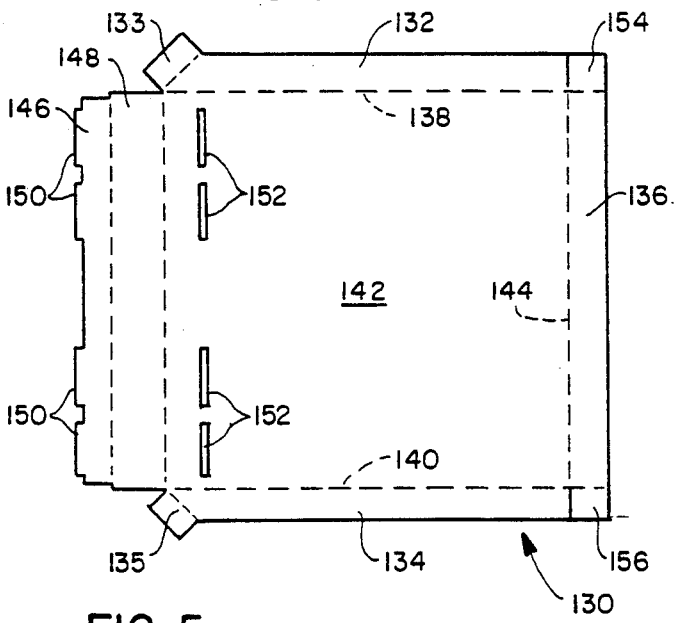
FIG. 3 is a plan view of a blank used to form a removable shelf according to the present invention.
Figure 4:
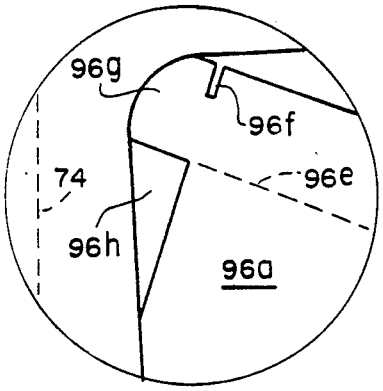
FIG. 4 is an enlarged view of a portion of the blank illustrated in FIG. 2.

Referring to FIG. 3, a shelf blank is depicted generally at 130 as having a pair of bendable side walls 132 and 134 and a perpendicular rear wall 136. Side wall 132 and 134 are foldable about parallel fold lines 138 and 140, respectively, and flank a platform 142. A foldable tab 133 is formed at one end of side wall 132, and a foldable tab 135 is formed at one end of side wall 134. Rear wall 136 extends between the side wall panels and is bendable about a fold line 144. A pair of front edge panels 146 and 148 are formed integrally with platform 142 and extend between side wall panels 132 and 134. Front edge panel 146 has a series of spaced apart teeth 150 which are aligned with corresponding openings 152 formed in platform 142.

Figure 9:
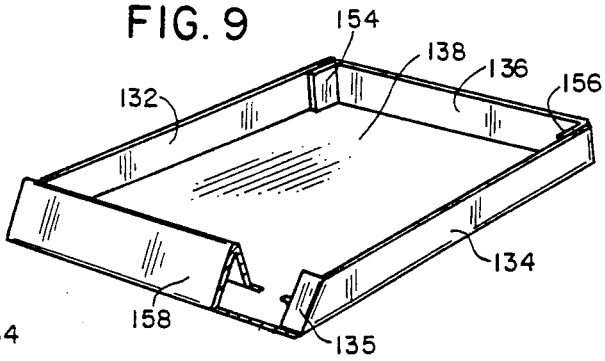
FIG. 9 is a perspective view, partially in section, of a removable tray in a display state.

The steps for converting a removable display tray from the flattened state illustrated in FIG. 3 to a display state illustrated in FIG. 9 can be summarized as follows. Side walls 132 and 134 and rear wall 136 are upwardly folded to define a generally upright container 138. Corner portions 154 and 156 intermediate the side walls and the rear wall and tabs 133 and 135 on the side wall panels are inwardly folded such that the outer edges of the container retain a substantially rectangular contour. Front edge panels 146 and 148 are then upwardly folded to define a triangular lip 158 along the front edge of the container, with the teeth 150 of panel 146 engaging the openings 152 and the triangular lip securing the tabs 133 and 135 to prohibit unfolding of the tray.

Figure 10:
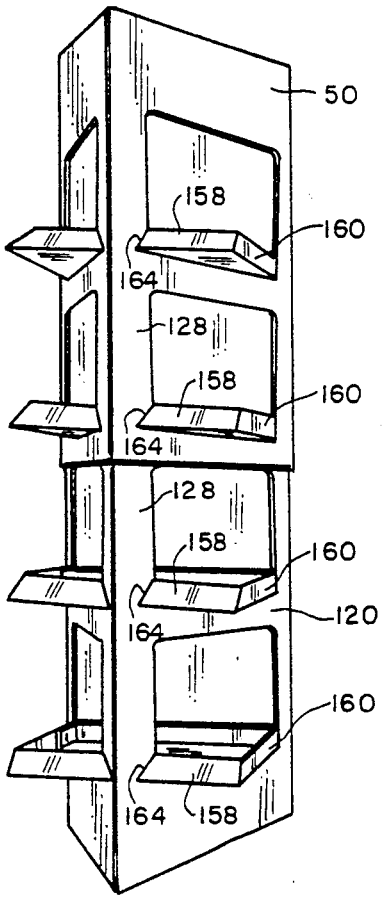
FIG. 10 is a perspective view of a display device according to the present invention showing the removable trays in place.
Figure 12:
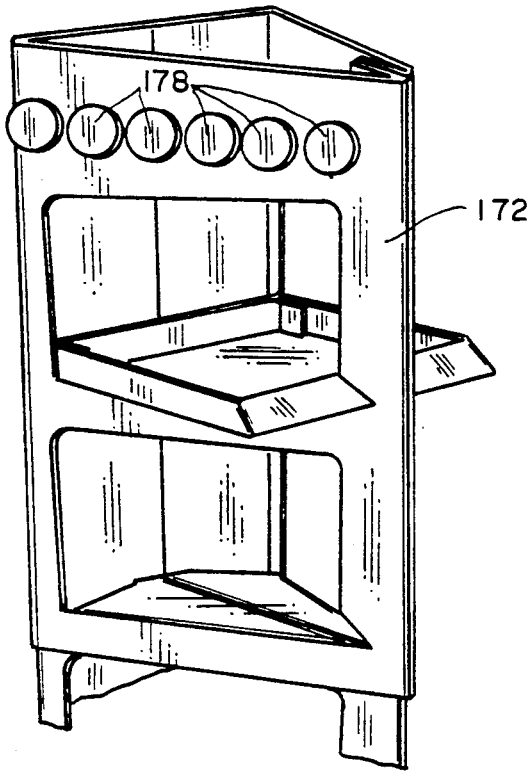
FIG. 12 is partial perspective view of a display module formed with the blank illustrated in FIG. 11.

FIG. 10 illustrates an assembled display device according to the present invention having a plurality of removable trays 160 positioned therewithin. Each tray is supported on a shelf formed within the triangulated storage space by the inwardly folded flaps struck from opposite side wall panels as previously described, and partially extends through the substantially rectangular openings formed in opposite side wall panels by the inwardly folded flaps. In order to enhance the engagement of the trays with the display device, each of the flaps 42, 44, 46, and 48 on upper display module 50 and each of the flaps 92, 94, 96, and 98 on lower display module have an integral triangular portion 162, such that the openings formed in the wall panels due to the inward folding of the flaps include a congruent triangular notch 164 extending into the support pillar 128. When each of the trays 160 is inserted in the display device, as illustrated in FIG. 10 and FIG. 12, the triangular notches 164 receive the triangular lip 158 formed on each tray and securely engage the forward end of the tray. After engaging the lip 158, each tray is lowered so that its rear wall 136 makes a close, firm frictional fit with the rear wall panel (such as 15, 65) to provide an interior bracing function fore and aft between the front pillar 128 and the rear wall panel. Note also that the bracing function is enhanced because tray side walls 132, 134 make a close fit rearwardly between opposite side wall panels adjacent the rear wall panel (FIG. 12). Thus the trays will not become inadvertently separated from the display, yet the trays may be easily removed to replenish articles to be displayed.

Figure 11:
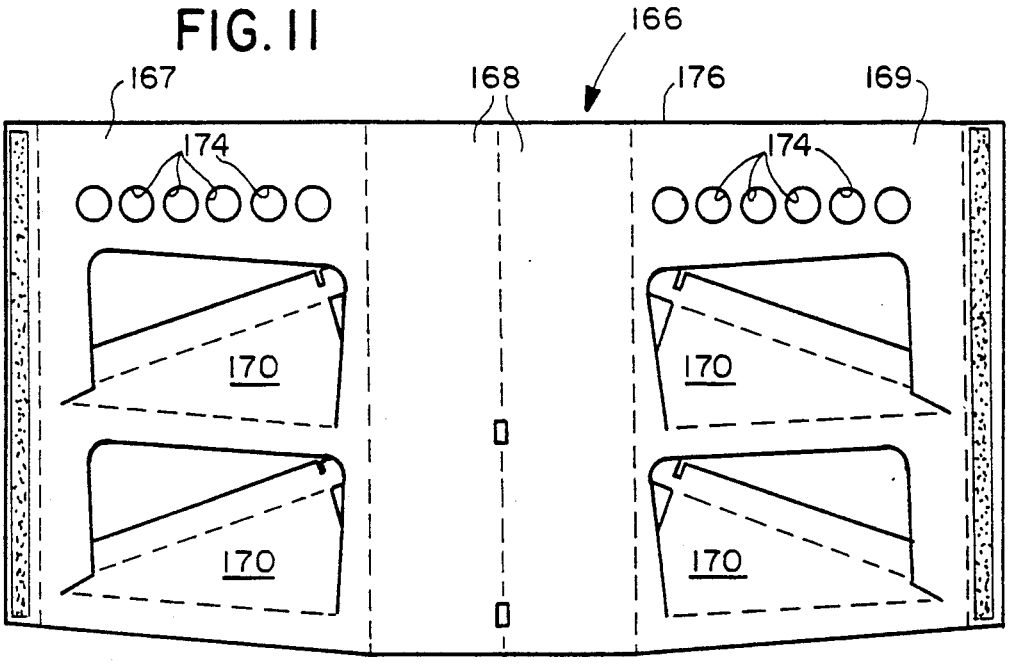
FIG. 11 is an elevational view of a blank used to form an alternate embodiment of the present invention.

In a modification of the exemplary embodiment, FIGS. 11 and 12 illustrate a wall blank 166 including a number of interconnected wall panels 167, 168 and 169 for defining an upper display module 172 with foldable flaps 170, generally as previously described. Wall blank 166 has a plurality of circular apertures 174 formed parallel to a top edge 176 and in vertical alignment with the flaps. The apertures advantageously position articles, such as cylindrical plastic containers or cans 178, for display adjacent the display trays.

Figure 13:
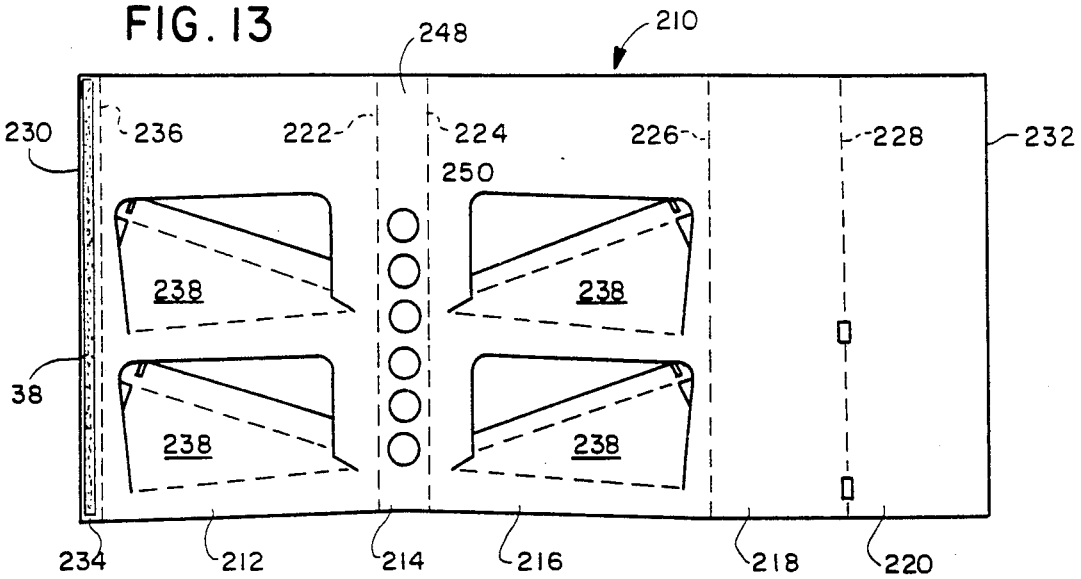
FIG. 13 is an elevational view of a blank used to form a second alternate embodiment of the present invention.
Figure 14:
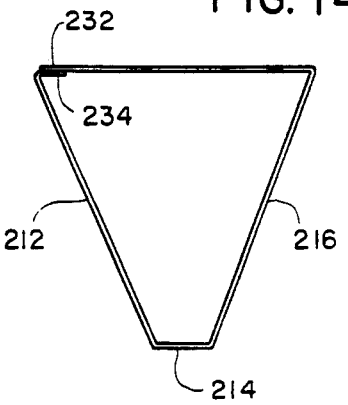
FIG. 14 is a top view of the blank illustrated in FIG. 13 in a folded state to form the continuous wall structure.
Figure 15:
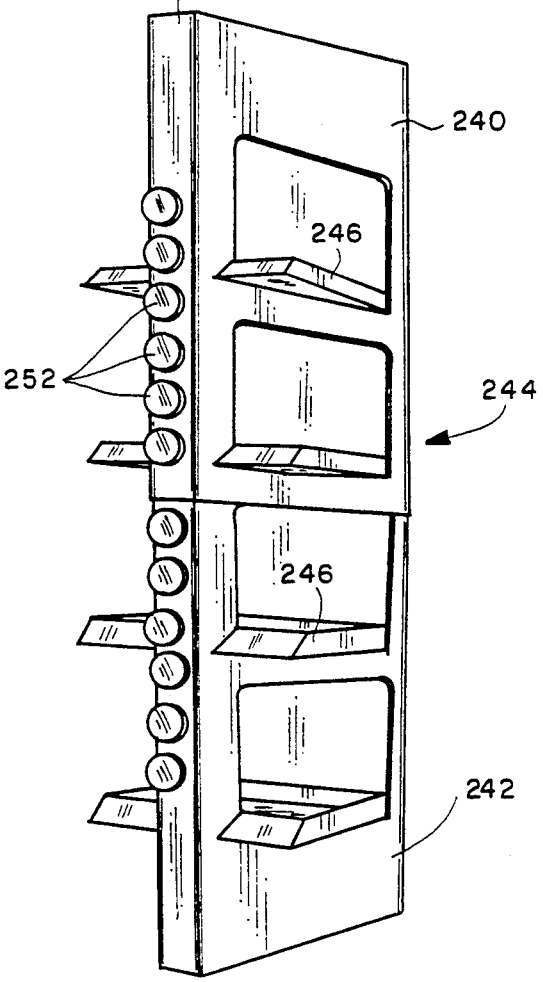
FIG. 15 is a perspective view of an alternate display device of two display modules each formed by the blank illustrated in FIG. 13.

In an alternate embodiment, and as shown in FIGS. 13–15, a blank 210 comprises a series of wall panels 212, 214, 216, 218 and 220 connected end to end foldably relative to each other about lines 222, 224, and 226 and 228, respectively. To provide a continuous wall structure, the free ends 230 and 232 of the blank are joined. The end 230 has an integral flap 234 which is bendable about a fold line 236 relative to panel 212. An adhesive 38 of a type known to those skilled in the art is used to facially mate the inwardly folded flap 234 on panel 212 with the free end 232 of panel 220 (see FIG. 14).

As in the exemplary embodiment described above, a plurality of flaps 238 are struck from and remain integral with the wall blank and are inwardly folded to define shelves within the display module. A pair of complementary wall blanks are used to form an upper display module 240 and a lower display module 242, which may be interconnected by means of previously described tabs and notches (not shown in FIG. 15) to form a stacked display device 244 for positioning a number of removable trays 246.

An important feature of the alternate embodiment of FIGS. 13–15 lies in the front panel 248 formed between the fold lines 222 and 224. Circular apertures 250 are formed in the front panel and allow for the display of generally cylindrical articles 252 in combination with the articles displayed on the trays 246. They trays 246 are preferably identical to trays formed from previously described tray blank 130 and perform the same functions.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A collapsible display device comprising:

a wall blank having at least a flat rear wall panel and two converging flat side wall panels foldably connected to the rear wall panel to define a continuous wall structure, the wall blank being collapsible to a flattened state for storage and transportation and convertible to an expanded display state in which the wall panels cooperatively bound a polygonally shaped inner display space, first and second substantially flat flaps respectively associated one each with the two converging side wall panels;

means attaching each of the first and second flaps foldably relative to its respective side wall panel so that each of the flaps can be swung inwardly of the display space into a juxtaposed position to afford openings in each of the side wall panels; and means interconnecting the first and second flaps with the rear panel whereby each of the first and the second flaps has a tab and the rear wall panel has a slot positioned to receive each of said tabs to interconnect the first and second flaps with the rear panels when the flaps are in juxtaposed position so that the juxtaposed flaps define a shelf within the polygonal display space for articles to be displayed.

2. The collapsible display device as specified in claim 1 in which the means attaching each of the first and second flaps to its respective side wall panel is a line of fold at the bottom of each flap, each line of fold being inclined downwardly toward the rear wall panel so that each of the flaps moves arcuately downwardly and rearwardly adjacent the rear wall panel when the flaps are swung into juxtaposed position.

3. The collapsible display device as specified in claim 2 in which each of the flaps has a rear marginal edge portion shaped to make a close frictional fit with the rear wall panel when the flaps are in juxtaposed position to provide an inner brace for the continuous wall structure.

4. The collapsible display device according to claim 1 in which each of the first and second flaps respectively associated one each with the converging side wall panels is struck directly from its associated side wall panel and integrally, foldably attached thereto.

5. The collapsible display device according to claim 1, including an additional front wall panel connected foldably relative to one of the side wall panels, whereby the wall blank is convertible to an expanded display state in which the wall panels cooperatively bound a quadrangularly shaped inner display space.

6. The collapsible display according to claim 1 in which the wall blank has a plurality of apertures of predetermined geometry formed in the wall panels for positioning articles having a complementary geometry for display.

7. The collapsible display according to claim 1 having third and fourth substantially flat flaps respectively foldably associated with the first and the second converging side wall panels so that each of the third and fourth flaps can be swung inwardly of the display space into a juxtaposed position to afford additional openings in each of the side wall panels, and means interconnecting the third and fourth flaps with the rear panel when the third and fourth flaps are in juxtaposed position so that the third and fourth juxtaposed flaps define a second shelf within the polygonal display space for articles to be displayed.

8. A collapsible display device comprising:

a wall blank having a flat rear wall panel and two converging flat side wall panels connected end to end foldably relative to each other to define a continuous wall structure, the wall blank being collapsible to a flattened state for storage and transportation and convertible to an expanded display state in which the wall panels cooperatively bound a polygonally shaped inner display space, first and second substantially flat flaps respectively associated one each with the two converging side wall panels;

means attaching each of the first and second flaps foldably relative to its respective side wall panel so that each of the flaps can be swung inwardly of the display space into a juxtaposed position to afford openings in each of the side wall panels;

means interconnecting the first and second flaps with the rear panel when the flaps are in juxtaposed position so that the juxtaposed flaps define a shelf within the polygonal display space for articles to be displayed; and a display tray blank, the display tray blank having a flattened state for storage and transportation and convertible to an expanded display state for fitting within the polygonal display space adjacent the juxtaposed first and second flaps of the display device to provide a removable tray for displaying articles.

9. The collapsible display device according to claim 8, in which the display tray blank in its expanded display state within the display space extends from the rear wall forwardly to the converging side wall panels to afford an inner brace for the continuous wall structure.

10. The collapsible display device according to claim 9 having a support pillar integrally formed between the first and the second flaps and extending therebetween, the collapsible display device further having means for removably engaging the removable tray with the support pillar.

11. The collapsible display device according to claim 10 in which the means for removably engaging the removable tray with the support pillar comprises a lip formed on a forward edge portion of the display tray blank and a complementary notch formed in the support pillar for receiving the lip on the display tray blank.

12. A collapsible display device comprising:

first and second vertically stacked collapsible display modules, each of the first and second display modules having:

a wall blank having substantially flat wall panels connected end to end to define a continuous wall structure, the wall blank collapsible to a flattened state for storage and transportation and convertible to an expanded display state in which a number of wall panels cooperatively bound a triangulated storage space, two of the number of wall panels cooperatively bounding the storage space comprising a first and second wall panel joined at a common fold line, and one of the number of panels cooperatively bounding the storage space being a rear wall panel interconnecting the first and the second wall panels;

first and second substantially flat flaps respectively associated one each with the first and second wall panels;

means attaching each of the first and second flaps foldably relative to its respective wall panel;

means interconnecting the first and second flaps with the rear panel so that the first and second flaps are situated in juxtaposed relationship with one another and define a shelf within the triangulated storage space for placement of articles to be displayed; and means rigidifying the display device when the first and second display modules are situated in a vertically stacked arrangement including the first module having a slot and the second module having a projecting shoulder of a size to fit within the slot, the shoulder being engagable with the slot when the modules are positioned in vertical telescoped relation to rigidify the stacked modules.

13. A collapsible display device comprising:

a wall blank having substantially flat wall panels connected end to end to define a continuous wall structure, the wall blank collapsible to a flattened state for storage and transportation and convertible to an expanded display state in which a number of wall panels cooperatively bound a substantially triangulated display space, two of the number of wall panels cooperatively bounding the display space being a first and second wall panel and one of the number of panels cooperatively bounding the storage space being a rear panel interconnecting the first and the second wall panels;

first and second substantially flat flaps respectively associated one each with the first and second wall panels;

a vertically extending support pillar formed forwardly of the rear panel between the first and the second flaps;

means attaching each of the first and second flat flaps foldably relative to its respective wall panel;

means interconnecting the first and second flaps with the rear panel so that the first and second flaps are situated in juxtaposed relationship with one another to define a shelf within the display space; and a display tray blank having a flattened state for storage and transportation and convertible to an expanded display state for fitting within the triangulated display space adjacent the juxtaposed first and second flaps and providing a removable tray for displaying articles.

14. The collapsible display according to claim 13 in which each of the first and second wall panels has rear and forward marginal edge portions, the rear marginal edge of each first and second wall panel being joined to the rear wall panel, and the forward marginal edge of each first and second wall panel being joined to the support pillar, the wall structure being foldable between the support pillar and the wall panels.

15. The collapsible display device according to claim 13, in which the display tray blank when in an expanded display state is provided with a forward lip and closely fits between the rear wall panel and the pillar to brace the continuous wall structure, the pillar having a rearwardly opening notch to receive the lip and secure the tray within the display space.

* * * * *